US007980051B2

(12) United States Patent
Beck et al.

(10) Patent No.: US 7,980,051 B2
(45) **Date of Patent: *Jul. 19, 2011**

(54) APPARATUS AND METHOD FOR PRODUCING COMPOSITE CABLE

(75) Inventors: Peter Joseph Beck, Christchurch (NZ); Rodney Alan Badcock, Lower Hutt (NZ); Marc Gregory Mulholland, Lower Hutt (NZ)

(73) Assignee: General Cable Superconductors Limited (NZ)

( * ) Notice: Subject to any disclaimer, the term of this patent is extended or adjusted under 35 U.S.C. 154(b) by 112 days.

This patent is subject to a terminal disclaimer.

(21) Appl. No.: 12/341,408

(22) Filed: Dec. 22, 2008

(65) Prior Publication Data

US 2009/0183486 A1 Jul. 23, 2009

Related U.S. Application Data

(63) Continuation-in-part of application No. 11/962,364, filed on Dec. 21, 2007, now Pat. No. 7,788,893.

(60) Provisional application No. 60/871,262, filed on Dec. 21, 2006.

(51) Int. Cl.
*D02G 3/36* (2006.01)

(52) U.S. Cl. ..... 57/13

(58) Field of Classification Search ..... 57/13, 14, 57/17, 18

See application file for complete search history.

(56) References Cited

U.S. PATENT DOCUMENTS 3,360,919 A 1/1968 Burr
4,549,391 A 10/1985 Toda et al.

*Primary Examiner* — Shaun R Hurley
(74) *Attorney, Agent, or Firm* — Blank Rome LLP

(57) ABSTRACT

A cable winding machine for winding together a multiple number of subconductors into a composite cable includes holding means for holding a first subconductor in the machine direction, and in a predetermined orientation of the first subconductor about its longitudinal axis as it moves through the machine; a first rotating member arranged and rotate the second subconductor around the first subconductor as the second subconductor moves through the machine and one or more further rotating members arranged to hold further subconductors aligned in the machine direction and in a predetermined orientation about their longitudinal axes and rotate the further subconductors around the subconductors wound with one another in the first winding stage of the machine.

33 Claims, 14 Drawing Sheets

APPARATUS AND METHOD FOR PRODUCING COMPOSITE CABLE

CROSS REFERENCE TO RELATED APPLICATION

This application is a continuation-in-part of U.S. patent application Ser. No. 11/962,364, filed Dec. 21, 2007, now U.S. Pat. No. 7,788,893 which claims the benefit of U.S. Provisional Application No. 60/871,262, filed Dec. 21, 2006, the entirety of which is incorporated herein by reference.

BACKGROUND

The invention relates to an apparatus and method for forming wound cables, such as Roebel or Rutherford cable, that involves minimal bending of the conductor elements.

FIELD OF INVENTION

Many applications of high $T_c$ superconductors (HTS), such as power transformers and high current magnets, require higher current than the capacity of presently available conductor tape. High currents can be attained by forming cables of multiple subconductors in which the individual conductors or conductor elements are continuously transposed such that each subconductor is electromagnetically equivalent. In this way current is equally shared and AC losses minimised. A spiral arrangement of conductors on the surface of a cylinder achieves this, but with inefficient use of space so that the overall engineering current density of the winding is reduced. The Roebel bar and Rutherford cable are transposed conductor cable configurations which combine high packing density with rectangular cross-section. The Rutherford cable has been used extensively with low $T_c$ superconductors—see for example, M. N. Wilson, "Superconductors and accelerators: the Good Companions", IEEE Transactions on Applied Superconductivity, Vol. 9, No. 2, June 1999, pages 111-121. The Roebel bar is long established as a high current copper conductor configuration for transformers and has been fabricated using HTS conductor—see J. Nishioka, Y. Hikichi, T. Hasegawa, S. Nagaya, N. Kashima, K Goto, C Suzuki, T Saitoh, "Development of Bi-2223 multifilament tapes for transposed segment conductors", Physica C volumes, 378-381 (2002) 1070-1072; V Hussennether, M. Oomen, M. Leghissa, H.-W. Neumüller, "DC and AC properties of Bi-2223 cabled conductors designed for high-current applications", Physica C 401 (2004) 135-139; and Suzuki et. al. "Strain properties of transposed segment conductors for a transmission cable", Physica C, volumes 392-396, (2003) pages 1186-1191.

In addition to the requirement for high-current conductor most AC applications of HTS demand low AC loss. In general this means that conductors should be transposed, electrically decoupled, and have minimal transverse dimensions. Because of the typically ribbon-like form of HTS conductors, it may be desirable for AC applications to manufacture conductor with narrower subconductor width than the usual DC conductor. An application might be, for example, in parts of windings exposed to appreciable AC fields oriented perpendicular to the face of the conductor. This narrow subconductor conductor will need to be made into a transposed multisubconductor conductor to give adequate current capacity for many applications. The shorter the transposition twist pitch, the lower the effective intersubconductor resistivity can be while still keeping the subconductors magnetically decoupled—see M. N. Wilson, "Superconductors and accelerators: the Good Companions", IEEE Transactions on Applied Superconductivity, Vol. 9, No. 2, June 1999, pages 111-121, equation 3. Provided decoupling is achieved, lower intersubconductor resistivity improves electrical and thermal stability and facilitates electrical connection to the cable.

There are presently two main HTS tape conductor types in production or development. Multifilament silver or silver alloy-sheathed composite conductor using the superconducting cuprate of composition $(Bi,Pb)_{2.1}Sr_2Ca_2Cu_3O_x$ (otherwise known as Bi-2223) is produced in commercial quantities by a powder-in-tube (PIT) manufacturing process involving drawing, rolling, and thermal treatment processes. A typical conductor will consist of approximately 55 HTS filaments embedded in a silver or silver alloy matrix, will have a cross-section of about 4 mm by 0.2 mm and a critical current at 77 K in self-field of up to 150 A.

Roebel-type cabled conductor made from PIT subconductors has been disclosed in the literature—see J. Nishioka, Y. Hikichi, T. Hasegawa, S. Nagaya, N. Kashirna, K Goto, C Suzuki, T Saitoh, "Development of Bi-2223 multifilament tapes for transposed segment conductors", Physica C 378-381 (2002) 1070-1072; and V Hussennether, M. Oomen, M. Leghissa, H.-W. Neumüller, "DC and AC properties of Bi-2223 cabled conductors designed for high-current applications", Physica C 401 (2004) 135-139.

Typically, the formation of a Roebel bar involves sequential steps in which the conductors are in turn laterally bent and then moved vertically. This places strain on the conductors and can damage them.

A method for forming Roebel bar cable by controlled bending of tapes of this type is described in U.S. Pat. No. 6,725,071 to C Albrecht, P Kummeth, P Massek, titled "Fully transposed high Tc composite superconductor, method for producing the same and its use". This takes account of the sensitivity of PIT tape to deformation-induced damage by imposing minimum limits on the edge-wise (i.e. in the plane of the tape) bending radius and bending zone length respectively of 100 times and 20 times the tape width. The resulting cable pitch for complete transposition is comparatively long.

"Second generation" or 2G HTS conductor is produced as a thin film of $YBa_2Cu_3O_7$ (Y-123) approximately 1 μm thick on a substrate of a base metal tape coated with various oxide films—see for example A. P. Malozemoff, D. T. Verebelyi, S. Fleshler, D. Aized and D. Yu "HTS Wire: status and prospects", Physica C, volume 386, (2003) pages, 424-430. Transposed 2G conductor has been disclosed—see Suzuki, Goto, Saitoh and Nakatsuka, "Strain Properties of Transposed Segment Conductors for a Transmission Cable", Physica C 392-396 (2003) 1186-1191. See also Japanese patent application publications 2003092033 and 2004030907.

Methods have been developed for laminating 2G wire with copper tape or electroplating with copper to protect the tape from thermal-electrical instability and, by locating the HTS film at or near the neutral axis for flat-wise (out-of-plane) bending, from mechanical stress. It is envisaged that standard conductor with around 4 mm width will be slit from the wide conductor. Edge-wise bending of 2G wire to form cables will, like PIT tape, be subject to limits on the minimum bending radius. There is, at present, no published data on the sensitivity of 2G wire to edge-wise bending. However, due to its different mechanical properties compared with silver and silver-alloy sheath material one might expect even more difficulty in edge-wise deformation.

SUMMARY OF INVENTION

In broad terms, in one aspect, the invention comprises a cable winding machine comprising:

feeding means to move multiple subconductors through the machine in a machine direction as the subconductors are wound together into a cable by the machine, holding means to hold a first subconductor as it moves forward through the machine, a winder (herein: first winder) arranged to rotate at least a second subconductor and a third subconductor about the first subconductor as the first, second and third subconductors move through the machine in the machine direction, so that the second subconductor winds with the first subconductor and then the third subconductor winds with the first and second subconductors, after the winder in the machine direction.

The first winder may be arranged to rotate the second and third subconductors and also at least one other subconductor so another subconductor or a first other subconductor winds with the first, second, and third subconductors and thereafter any other subconductors rotated by the first winder wind one after another with the subconductors wound together previously.

The cable winding machine may also include a second winder after the first winder in the machine direction and arranged to rotate at least one further subconductor about the subconductors wound together by the first winder, so that a said further subconductor winds following the second winder with the subconductors wound together by the first winder, or where the second winder is arranged to rotate two or more said further subconductors, so that a first further subconductor winds following the second winder with the subconductors wound together by the first winder, and then any other further subconductors rotated by the second winder wind one after another with the subcondutors wound together previously.

The cable winding machine may also comprise one or more yet further winders after the second winder in the machine direction, each further winder arranged to rotate at least one additional subconductor about the subconductors wound together by the prior winders so that an additional subconductor winds following its further winder with the subconductors wound together by the prior winders, or where each further winder is arranged to rotate two or more additional subconductors, so that a first additional subconductor winds following the further winder with the subconductors wound together by the prior winders, and then any other additional subconductors rotated by the further winder wind one after another with the subconductors wound together previously.

In a preferred form the first winder is arranged to hold said second subconductor for further in the machine direction than said first subconductor and to hold said third subconductor for further in the machine direction than said second subconductor so that said third subconductor winds with the first and second subconductors after in the machine direction the second subconductor winds with the first subconductor.

Where the first winder is arranged to rotate one or more other subconductors it may be arranged to hold each of these other subconductors for further again in the machine direction, so that these other subconductors wind one after another with the subconductors wound together previously.

Where the machine comprises a second winder, in this preferred form the second winder is arranged to hold each further subconductor for different spacings in the machine direction, so that subconductors rotated by the second winder also wind one after another with the subconductors wound together previously.

Where the machine comprises one or more further winders after the second winder then in this preferred form each further winder is arranged to hold each additional subconductor for different spacings in the machine direction, so that subconductors rotated by each further winder wind one after another with the subconductors wound together previously.

In a preferred from the first winder is arranged to hold the first subconductor in a predetermined orientation as it moves through the machine in the machine direction, and the second, third, and any further subconductors wound by the first winder in a predetermined orientation relative to said first subconductor and with each other as the first winder rotates the second, third, and any further subconductors about the first subconductor.

A second winder may be arranged to hold further subconductor(s) which it winds in the predetermined orientation as the further subconductor(s) move(s) forward through the machine in the machine direction and as it rotates these further subconductor(s) about the subconductor(s) wound together by the first winder.

Any further winders may be arranged to hold further subconductor(s) in the predetermined orientation as the further subconductor(s) move forward through the machine in the machine direction and are rotated about the subconductor(s) wound together by the prior winders.

In broad terms in another aspect the invention comprises a cable winding method comprising:

moving multiple subconductors through a cable winding machine in a machine direction as the subconductors are wound together into a cable by the machine, holding a first subconductor as it moves forward through the machine, rotating at least a second subconductor and a third subconductor about the first subconductor as the first, second and third subconductors move through the machine, so that the second subconductor winds with the first subconductor and then the third subconductor winds with the first and second subconductors, after the winder in the machine direction.

The method may also include holding the first subconductor in a predetermined orientation as it moves through the machine and the second, third, and any one or more other subconductors in a predetermined orientation relative to the first subconductor and with each while rotating the second, third, and one or more other subconductors about the first subconductor.

The subconductors may each have a width dimension across a longitudinal axis greater than a depth dimension through the longitudinal axis perpendicular to the width direction and holding the subconductors in said predetermined orientation may comprise holding the subconductors with the width dimension of the subconductors parallel as the subconductors move through the machine. The subconductors may have a serpentine shape. The subconductors may comprise a high $T_c$ superconducting layer.

BRIEF DESCRIPTION OF THE DRAWINGS

Preferred embodiments of the invention are described by way of example with reference to the accompanying drawings, in which.

DETAILED DESCRIPTION OF PREFERRED FORMS

Figure 1:
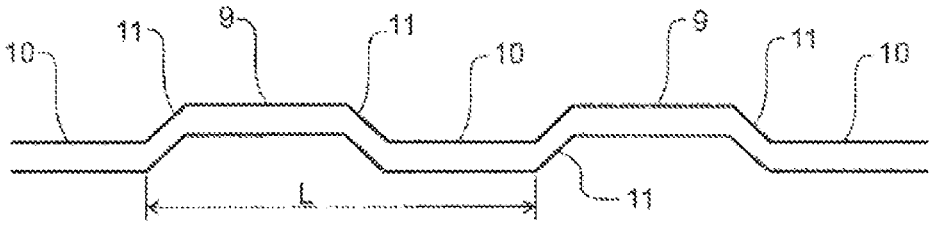
FIG. 1 shows a length of a serpentine subconductor.

FIG. 1 shows a length of serpentine subconductor. The subconductor comprises straight sections 9 and 10 and transition sections 11. The relative size and shape of the straight sections and transition sections may vary dependent on the design of the cable to be produced. It is desirable to shape the subconductors so that there are both lateral and longitudinal spaces formed between the subconductors in the finished cable as shown in FIG. 2. The length L shown is the transposition length of the subconductor.

Figure 2A:
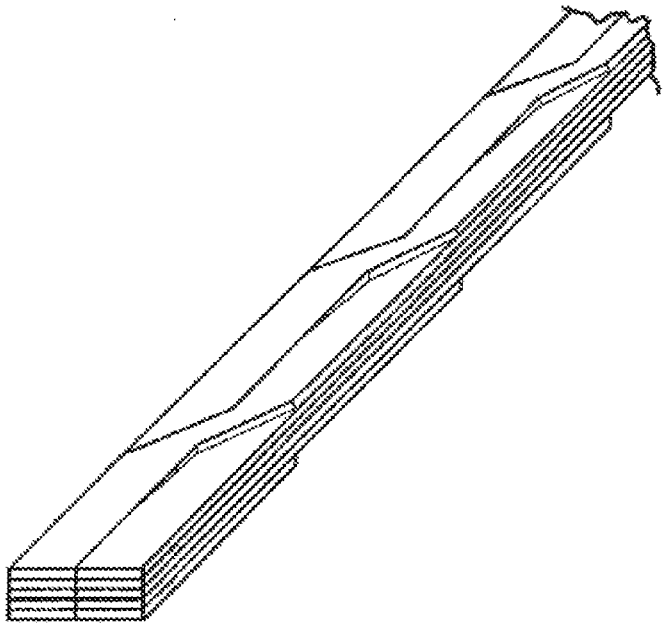
FIG. 2A shows a length of Roebel cable formed from ten subconductors.
Figure 2B:
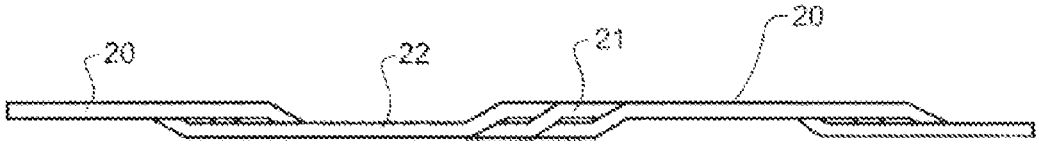
FIG. 2B shows a length of Roebel cable formed from three subconductors, in each case of the type shown in FIG. 1.

FIGS. 2A and 2B each show a short length of Roebel cable, consisting of ten and three wound subconductors of the type shown in FIG. 1 respectively. In FIG. 2B the three subconductors are indicated at 20, 21, and 22. In each case the subconductors are wound around each other along their entire length. The invention relates to a method and machine for winding composite cable of this type, from subconductors of the type shown in FIG. 1.

Embodiments of the cable winding machine and method are particularly useful for producing composite (transposed) superconducting cable, allowing subconductors to be wound (or transposed) around one another with minimal stress on the subconductors. Superconducting wires typically consist of a flat ribbon-like substrate on which a layer or thin film of HTS crystal is deposited. Stresses on the conductors caused by bending, flexing and twisting during winding of for example Roebel cable can damage the crystal structure of the HTS layer and so reduce conductivity.

Figure 3:
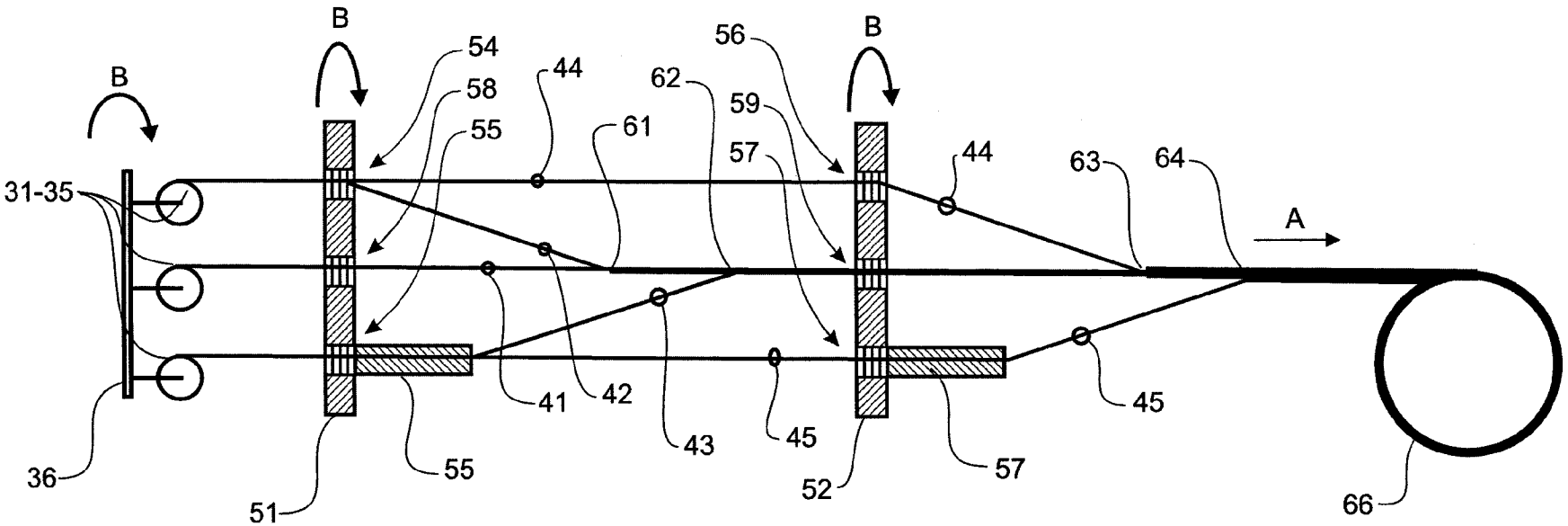
FIG. 3 is a schematic illustration of one embodiment of a cable winding method and machine of the invention.
Figure 4:
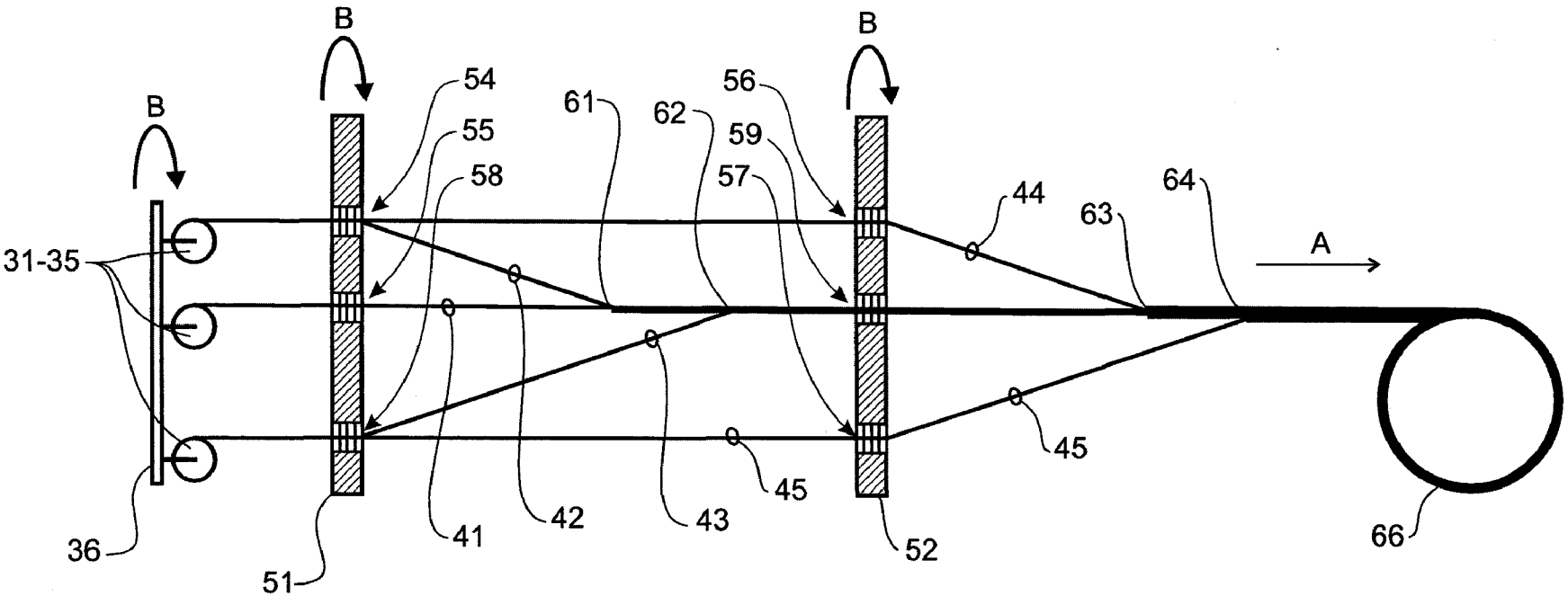
FIG. 4 is a schematic illustration of another embodiment of a cable winding method and machine of the invention.

FIGS. 3 and 4 schematically illustrate embodiments of a cable winding method and machine of the invention. In each embodiment a cable winding machine for winding cable from five subconductors has five spools 31-35 from each of which a subconductor is unwound into the machine, and which are all carried by a rotating spool holder 36 which rotates about a machine direction indicated by arrow A while maintaining the spools 31-35 in a fixed orientation relative to ground and relative to one another as the spool holder 36 rotates. The subconductors are unwound from the spools 31-35 and move forward through the machine at a similar speed. A first or central subconductor 41 moves through the machine in the machine direction and along a central axis also referred to herein as the machine axis, preferably substantially without twisting about its longitudinal axis. Winder 51 and winder 52 spaced from winder 51 along the machine axis also rotate about the machine axis and at the same speed, as indicated by arrows B one of which also indicates rotation of the spool holder 36 which also rotates at the same speed as the winders 51 and 52.

A second subconductor 42 and third subconductor 43 unwind from other spools 32 and 33 carried by the spool holder 36. The first subconductor moves through an aperture 58 in the centre of winder 51, aligned with the rotational axis of the winder 51 and the machine axis. The second and third subconductors 42 and 43 are held by and rotated about the first subconductor 41 by the winder 51. A holder 54 in the winder 51 holds the second subconductor 42 as the winder rotates and as the subconductor moves through the winder in the machine direction. Another holder 55 in the winder 51 holds the third subconductor 43 as the winder rotates and as the subconductor 53 moves through the winder in the machine direction. The holders 54 and 55 are spaced radially from the rotational axis of the winder. The second subconductor 42 subsequently winds with the first subconductor 41 at winding point 61. The third subconductor 43 then winds with the first and second subconductors 41 and 42 at winding point 62 spaced from point 61 in the machine direction. To space the winding point 62 from the winding point 61 the holder 55 in the winder 51 is longer in the machine direction than the holder 54 for the second subconductor 42, so that the winder 51 holds the third subconductor 43 for longer in the machine direction than it holds the second subconductor 42.

Fourth and fifth subconductors 44 and 45 unwind from other spools 34 and 35 and pass through apertures in the first winder 51 and are held by holders 56 and 57 in the second winder 52 as the subconductors 44 and 45 move through the winder. After winding together, the first, second and third subconductors 41-43 move through an aperture 59 in the centre of winder 52, aligned with the rotational axis of the winder in the machine direction. Fourth subconductor 44 and fifth subconductor 45 are held and rotated by the second winder 52 about the previously wound together first-third subconductors 41-43, and following the winder 52 in the machine direction first the fourth subconductor 44 winds therewith at winding point 63 and then the fifth subconductor 45 winds on at winding point 64. A longer holder 57 in the second winder 52 holds the fifth subconductor 45 for longer in the machine direction than the holder 56 in the second winder 52 holds the fourth subconductor 44, to space the winding points 64 and 63.

The wound cable is subsequently taken up onto spool 66.

Serpentine subconductors of the type shown in FIG. 1 and as described previously may be unwound from the spools 31-35 and moved in the machine direction with a longitudinal displacement between the subconductors of L/n where L is the subconductor transposition length and n is the total number of subconductors wound in the cable. The second subconductor 42 is unwound from its spool 31 and subsequently winds with the centre subconductor 41 with a displacement of conductor 42 in the forward direction of L/n relative to the centre conductor 41, the third subconductor 43 is unwound from its spool and subsequently winds with the first and second subconductor with a displacement in the machine direction of 2L/n relative to the centre subconductor 41, and the fourth and fifth subconductors 44 and 45 are unwound from other spools 34 and 35 and subsequently wind on with displacement in the machine direction relative to conductor 41 of 4L/n and 5L/n respectively. The spacing between the winding points 61 and 62 and the winding points 63 and 64 is one half of the transposition length L of the subconductors i.e.

L/2, +/−L/n. The spacing between successive winding points from the last winding point of a winder and the first winding point of a following winder is an integer number of half transposition lengths plus or minus the spacing between successive strands, i.e. m*L/2+/−L/n where m is any integer. The holder 55 in the winder 51 is longer in the machine direction than the holder 54 in the winder 51 for the second subconductor 42, by the same spacing between the winding points 61 and 62, so that the winder 51 holds the third subconductor 43 for longer in the machine direction than it holds the second subconductor 42. Similarly holder 57 in the second winder 52 holds the fifth subconductor 45 for longer in the machine direction than the holder 56 in the second winder 52 holds the fourth subconductor 44, to space the winding points 64 and 63.

The winders 51 and 52 may also be arranged to hold the first subconductor 41 in a predetermined orientation about its longitudinal axis as it moves through the machine i.e. so as not to allow it to rotate relative to ground about its longitudinal axis, and the winders may be arranged to also hold the other subconductors in a predetermined orientation relative to ground/to said first subconductor and with each other as they are wound on i.e. as the winders rotate. The subconductors may be in ribbon form i.e. have a width across a longitudinal axis greater than a depth dimension through the longitudinal axis perpendicular to the width direction, and the holders 54-57 may hold the subconductors with the width dimension of the subconductors parallel as the subconductors move through the machine. Where the subconductors comprise a high $T_c$ superconducting layer on serpentine substrate for example, this will avoid bending and potentially damaging the HTS layer as the subconductors are wound into a composite cable. The holders may each comprise a slot guide which counter rotates within the winder as will be further described, where it is desired to maintain the subconductors in a predetermined orientation about their longitudinal axis as they move through the machine.

The embodiment of FIG. 4 is similar to that of FIG. 3 and similar reference numerals in FIG. 4 indicate similar elements as in FIG. 3, except that to achieve the desired spacing between the winding points 61 and 62 following the first winder 51 and winding points 63 and 64 following the second winder 52 the holders 54 and 55 in the winder 51 instead of being of different lengths in the machine direction, are spaced at different radii from the central axis of the winder 51 and the holders 56 and 57 in the winder 52 for the fourth and fifth subconductors 44 and 45 are spaced at similarly different radii from the central axis of the holder 42.

As many subconductors as required in a finished cable can be wound by increasing the number of subconductors that are wound on by each winder and/or by increasing the number of winders.

Any of the subconductors can itself be formed from multiple previously wound subconductors.

Figure 5:
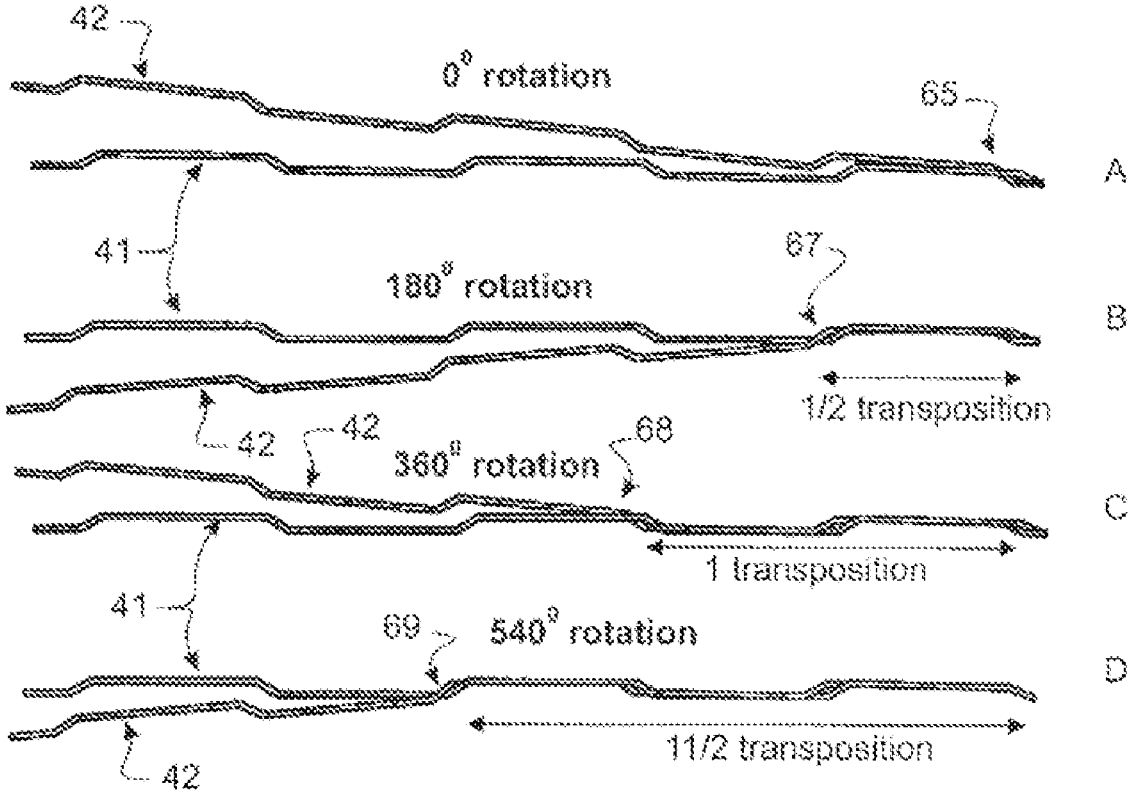
FIGS. 5A-D schematically illustrate steps in the cable winding method of the invention.

It is important to maintain a constant angle called the "winding angle" between the central subconductor or group of previously wound subconductors and a next subconductor being wound on, herein after referred to as the "active subconductor". The crossing point referred to herein is the position at which the active subconductor first contacts the central subconductor or subconductor group. FIGS. 5A-D illustrate how the active subconductor will wind with the centre subconductor or group of subconductors. The first crossing between an active subconductor and the centre subconductor or group occurs at crossing point indicated at 65 in FIG. 5A. For example referring to FIGS. 3 and 4 the first crossing between the subconductor 42 and subconductor 41 occurs at winding point 61, and the first crossing between the subconductor 43 and the subconductors 41 and 42 previously wound together occurs at winding point 62. After 180° of rotation of the subconductor 42 by winder 51, about the centre subconductor 41, a second crossing 67 indicated in FIG. 5B occurs at the same winding point 61, noting that both (and all other) subconductors have also moved forward through the machine by one half transposition length i.e. L/2, in the machine direction. Following a further 180° of winder rotation a third crossing occurs at the winding point 68, as illustrated in FIG. 5C, and following a further 180° of rotation (540° of rotation relative to FIG. 5A) a fourth crossing 69 occurs as illustrated in FIG. 5D. The winding machine may operate with a step and rotate action in which after each rotation of all winders by 180° in unison, all subconductors are moved through the machine in the machine direction by L/2 following which the winders rotate by a further 180° followed by a further L/2 step forward of the subconductors in the machine direction and so on. In an alternative embodiment the machine may operate continuously i.e. with continuous rather than stepping rotating and forward movement actions.

Figure 6:
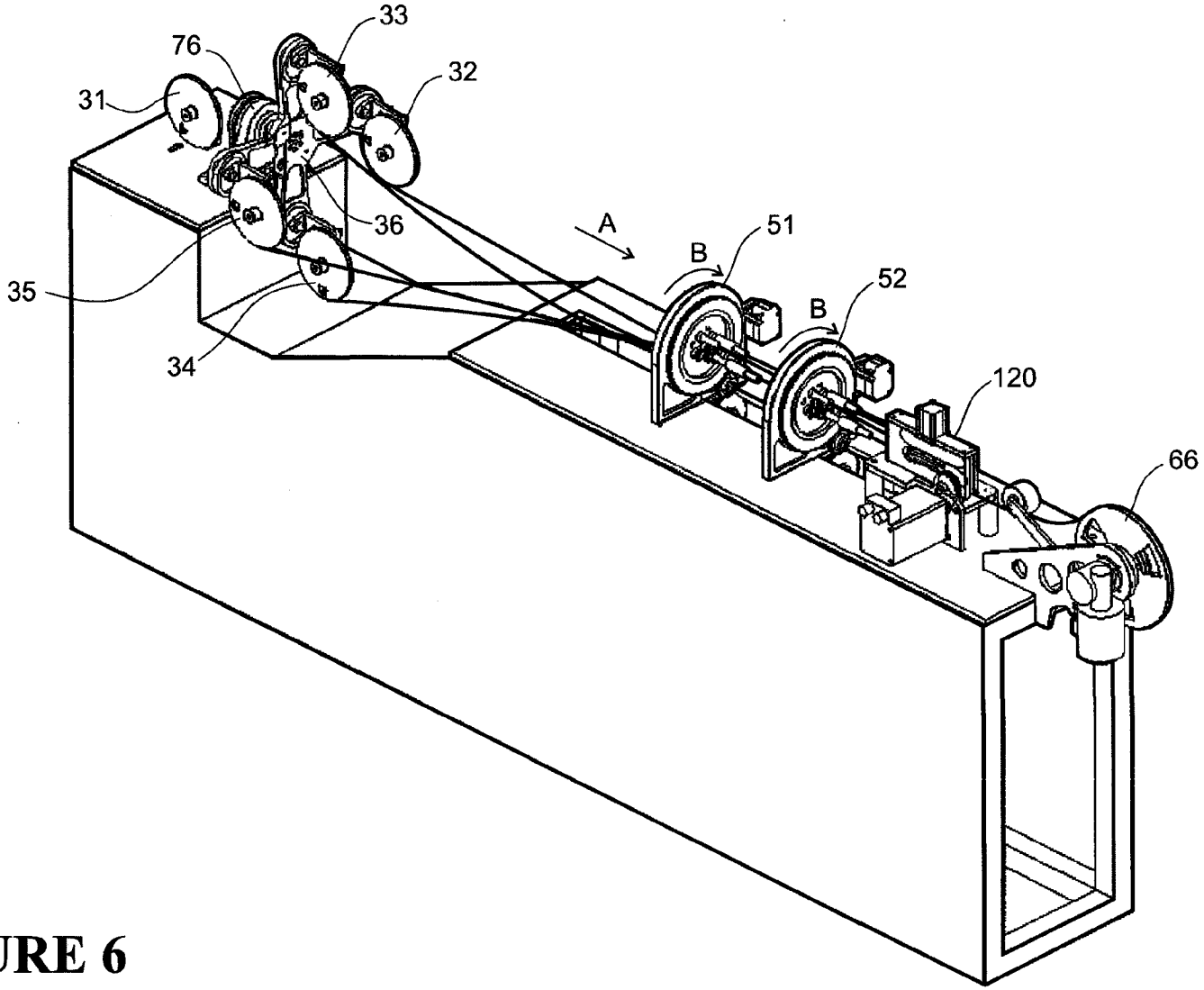
FIG. 6 is a perspective view of a cable winding machine of the invention.
Figure 10:
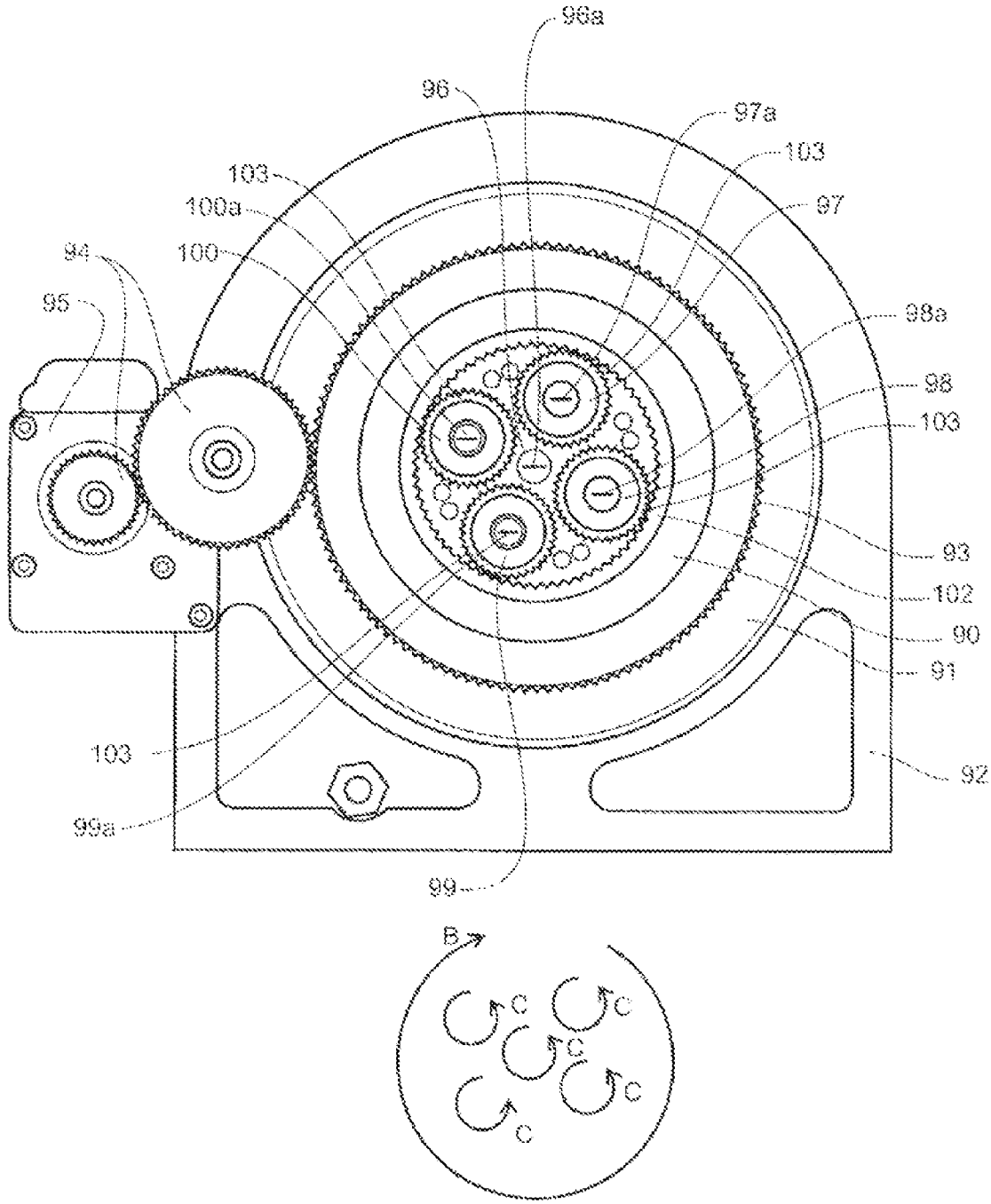
FIG. 10 is a side on view of one of a rotating winder of the machine, from the same side as FIG. 9.
Figure 11:
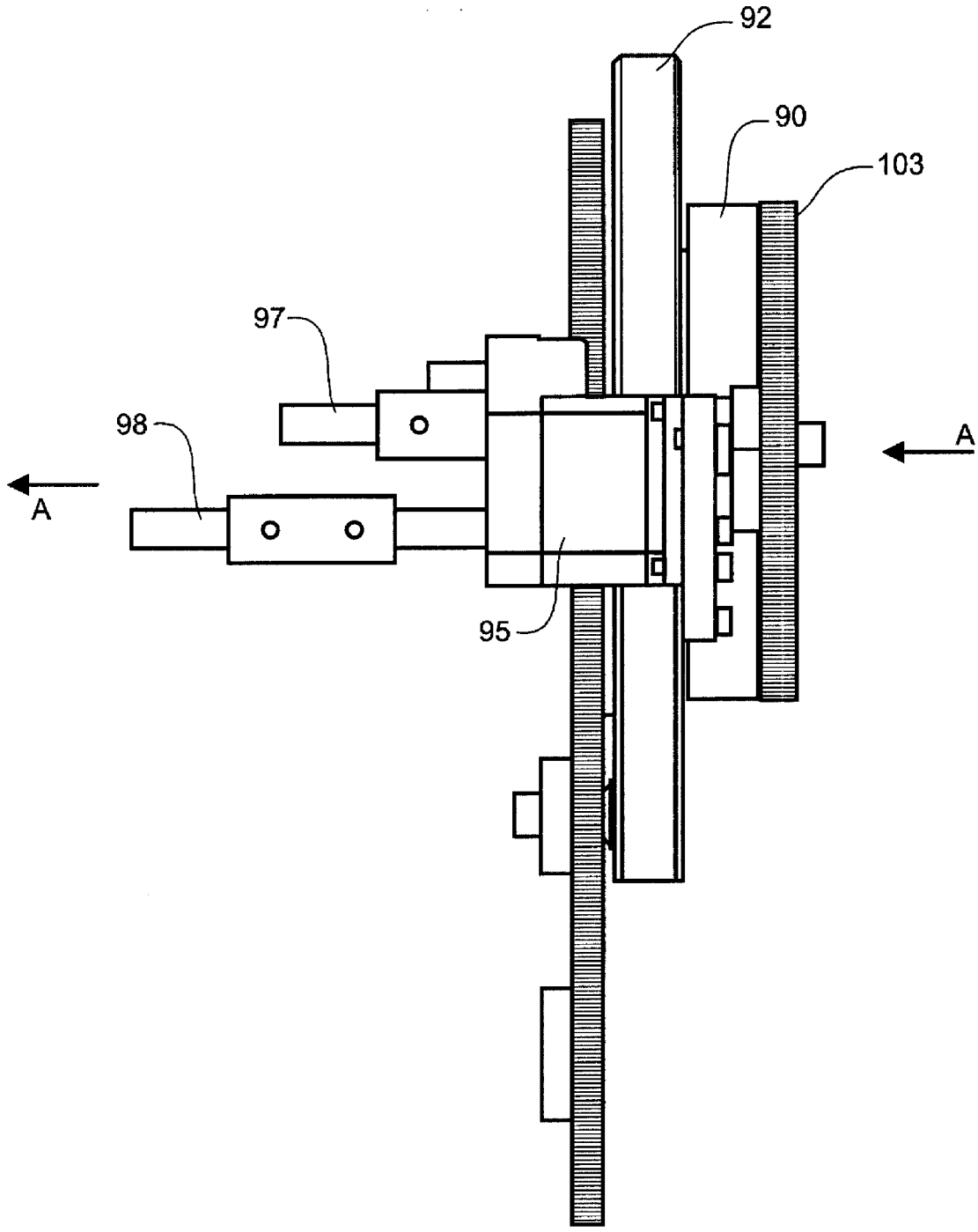
FIG. 11 is a perspective view from the other side of a rotating winder.
Figure 12:
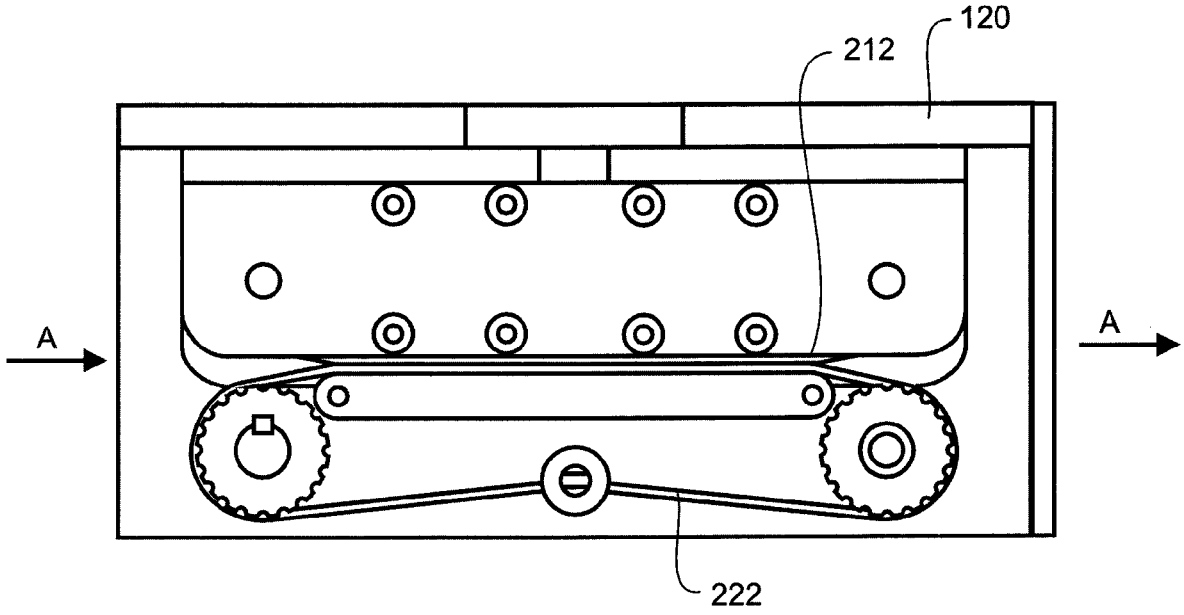
FIG. 12 is a schematic cross-section view of a drive unit of the machine.

FIGS. 6-12 show an embodiment of a cable winding machine of the invention in detail, similar to that described above with reference to FIG. 3. Many reference numerals in FIGS. 6-12 indicate similar elements as in FIG. 3. Referring first to FIG. 6 which is an overall view of the machine, in this embodiment unwind spool 31 for first or centre subconductor 41 is mounted on the machine bed behind spool holder 36 which carries spools 32-35 from which unwind in operation subconductors 42-45, all in the machine direction indicated by arrow A in FIG. 6. The mounting and drive system for the spool holder 36 and spools 31-35 is shown in more detail in FIGS. 7 and 8. The machine has two winders 51 and 52 which are shown in more detail in FIGS. 9-11. A drive unit 120 which draws the subconductors through the machine in the machine direction is shown in FIG. 12. A take up reel 66 is positioned after the drive unit to take up the wound cable.

Figure 7:
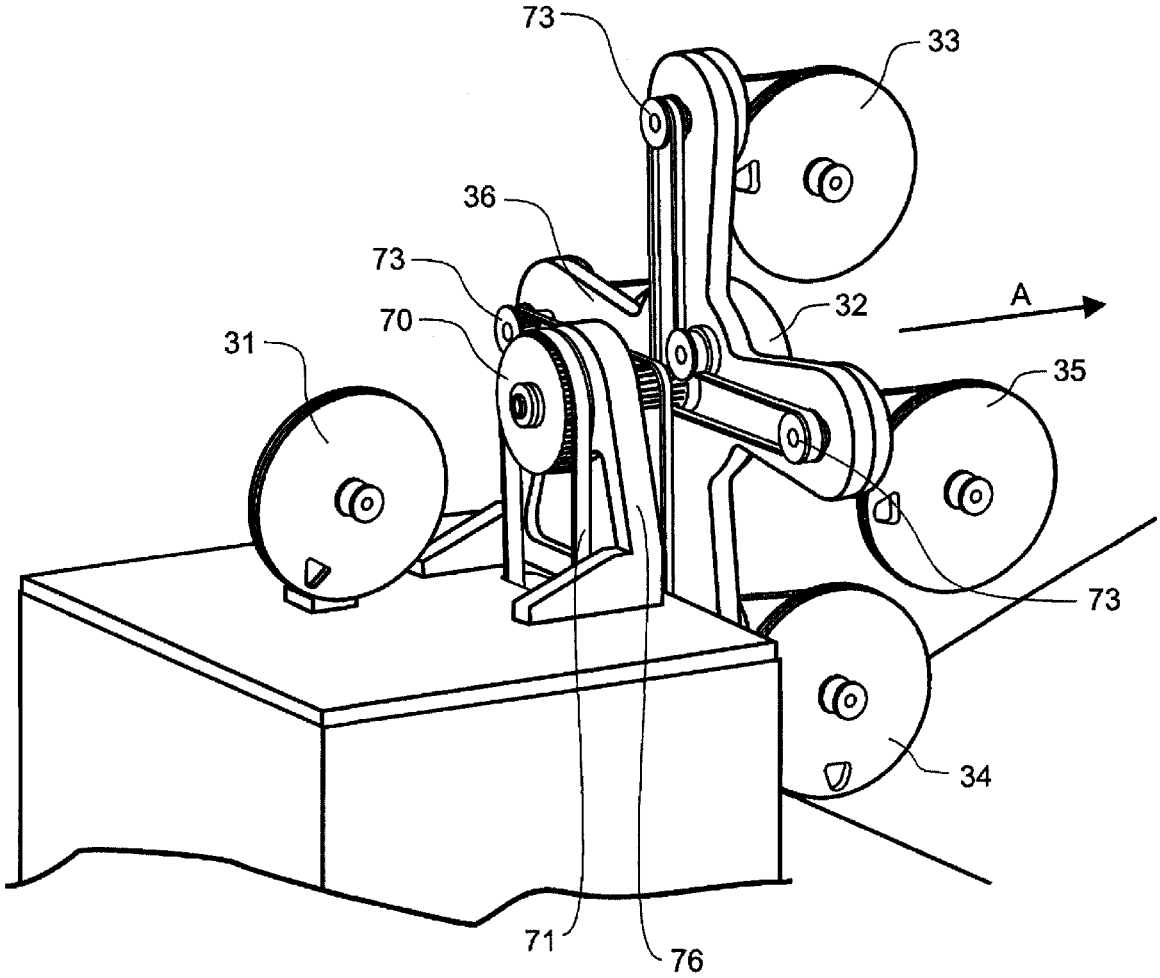
FIG. 7 is a perspective view from one side of part of the machine of FIG. 6.
Figure 8:
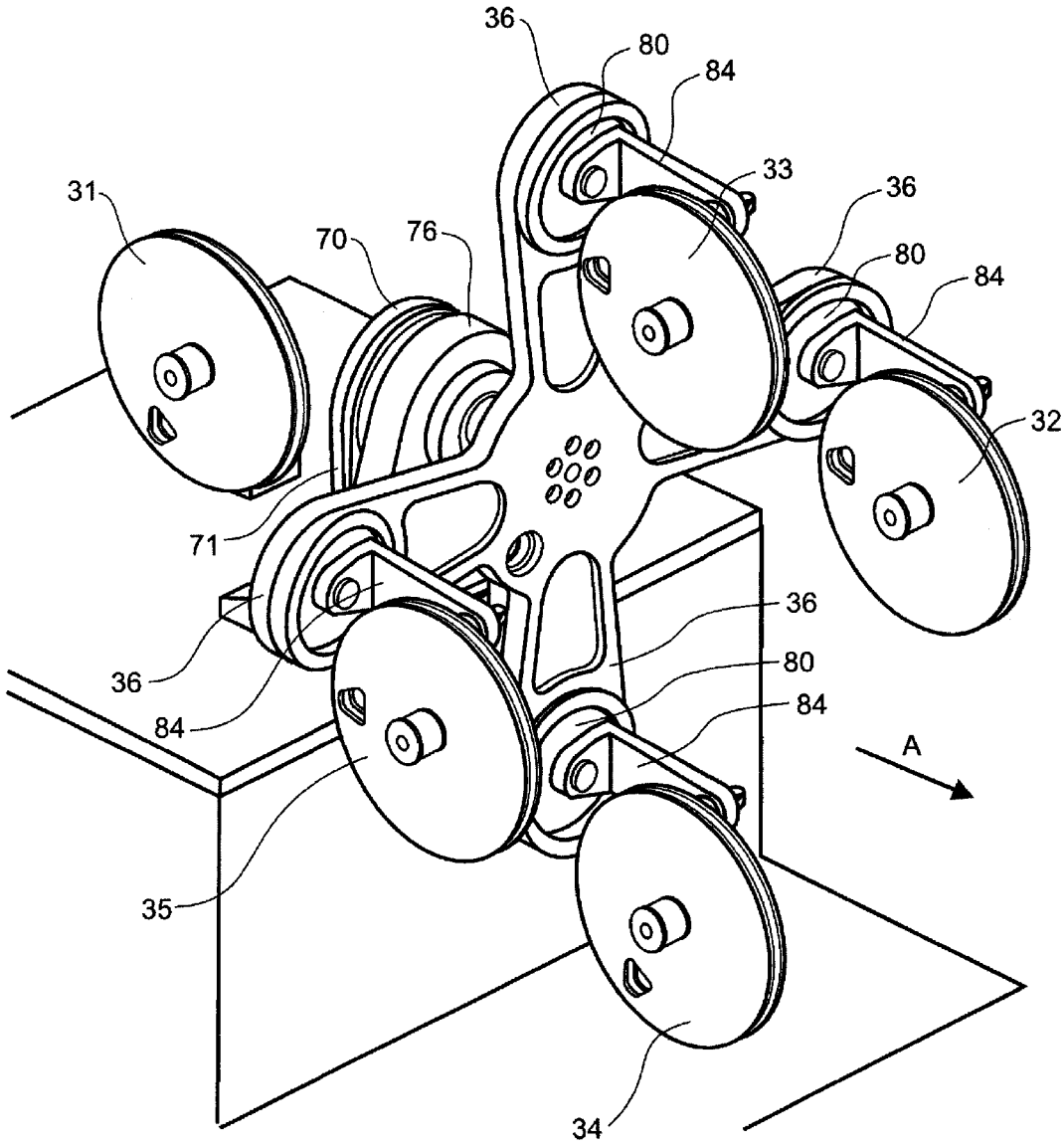
FIG. 8 is a perspective view from another side of the part of the machine shown in FIG. 7.

Referring to FIGS. 7 and 8 the subconductor spools 31-35 are mounted for rotation each about an axis transverse to the machine direction, and the spool holder 36 is mounted to rotate about the machine axis or close thereto. The spool 31 is also aligned with the machine axis so that the subconductor 41 unwinds from the spool 31 along the machine axis or close thereto with minimal bending or stress on the first subconductor. The spool holder is journalled for rotation in a support frame 76 mounted to the machine bed, and through which a shaft passes from the centre of the spool holder back to a drive pulley 70 coupled to a motor (not shown) via a belt 71 or alternatively gears.

Four spool wheels 73 are coupled to a static shaft by belts. Pulleys 73 are mounted at the ends of shafts journalled through the arms of the rotating spool holder 36 which support each of the subconductor spools 32-35 and a belt 72 passes about the pulleys 73 and couples directly or indirectly to the drive system so that rotation of the spool holder 36 causes counter rotation of each of the spools 32-35 to maintain the spools in a fixed vertical orientation shown throughout 360° rotation of the spool holder 36. The subconductors 42-45 unwound from the spools 32-35 are thus all retained in the same orientation relative to each other (they are retained in this orientation throughout the machine) as they are unwound, and do not twist about their own axis during the winding process and so stress on the subconductors is minimised.

Referring to FIG. 8 for each spool 32-35 a variable height disc 80 is fixed to an end of an arm of the rotating spool holder 36. Each spool is mounted via a support arm 84. A cam follower 81 is mounted to the spool via an articulated connector 82 that is connected to the spool support arm via pin 83. As the spool counter rotates relative to the rotating spool holder, the cam follower 81 travels around the upper surface of the disc 80. Movement of the cam follower caused by the profile of the disc causes the articulated connector and hence the spool to pivot about the pin 83. The disc 80 is profiled to maintain a constant angle between the central axis and the spool.

Figure 9:
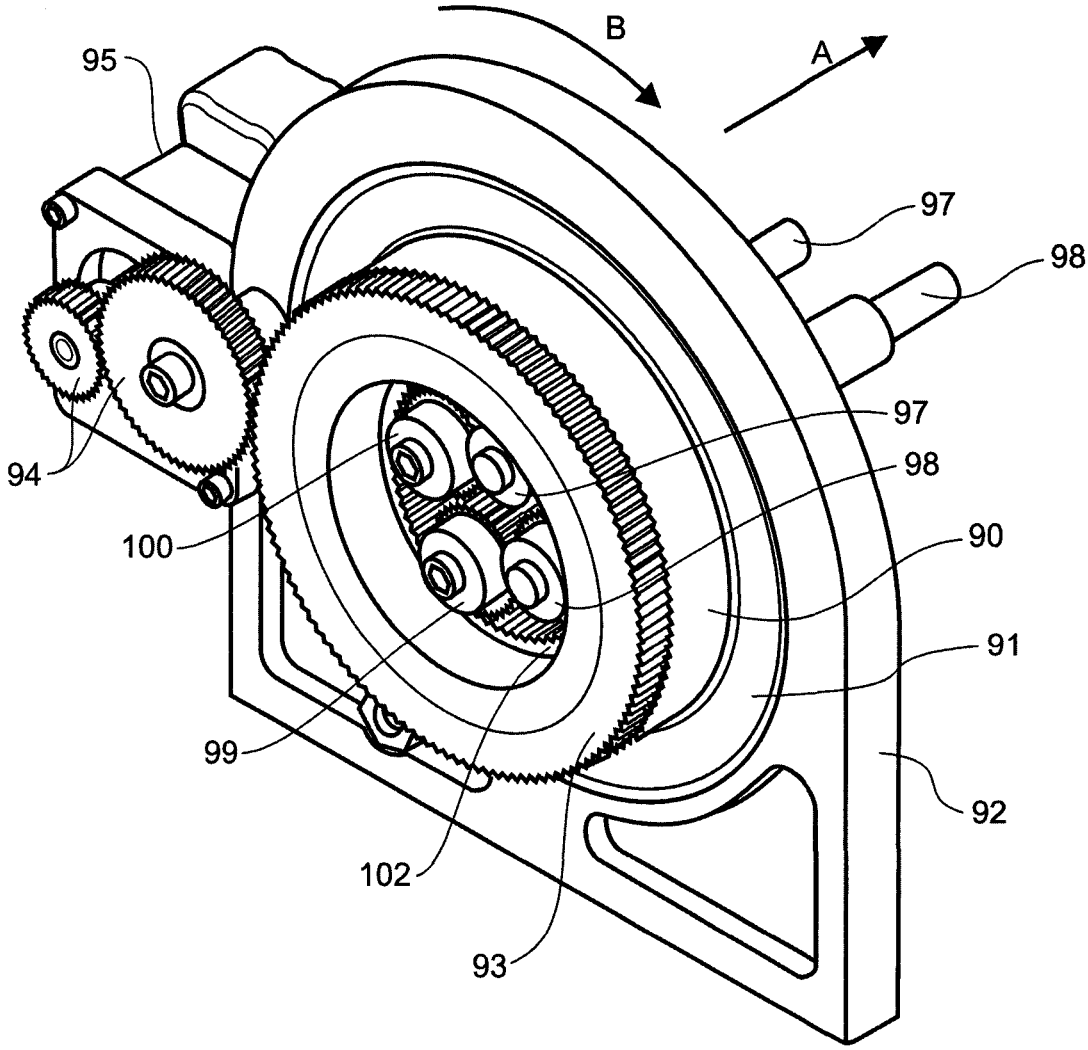
FIG. 9 is a perspective view from one side of one of the rotating winders of the machine.

FIGS. 9-11 show one winder 51 or 52. Each winder comprises a rotating wheel 90 mounted for rotation in a large diameter bearing 91 in turn mounted in a frame 92 fixed to the machine bed. The wheel 90 rotates in the frame 92 in the direction of arrow B in FIG. 11 (and also FIGS. 3 and 4) and comprises an annular gear 93 around its periphery which engages gears 94 which are in turn driven from electric motor 95. Both winders 51 and 52 are driven at the same speed, and at the same speed or angular velocity as the rotating spool holder 36. FIGS. 9 and 10 show the 'entry' side of the winder i.e. the side facing the rotating spool holder 36. FIG. 11 is a side view of the winder.

A holder 96 (see particularly FIG. 10) mounted centrally in the winder has an aperture 96*a* through the holder in the machine direction and along the machine centre axis by which the centre conductor, or group of conductors if the winder is one after the first, moves through the winder. In the embodiment shown the centre holder 96 is surrounded around the central axis of the winder by four further holders 97-100, each also comprising an aperture 97*a*-100*a* through the winder in the machine direction. The embodiment shown is for winding cable from five subconductors each having an identical serpentine shape and a flat cross-section—the subconductors thus have a tape form. In the first winder 51 the apertures 97*a*-98*a* through the holders 97 and 98 through which the subconductors 42 and 43 pass have a horizontal slot shape in cross-section as shown, which allows the tape subconductors to pass through the holders but which maintains their horizontal orientation as the subconductors pass through the winder. On the exit side of the winder the holders 97 and 98 have a different length. The holder 98 for the tape 43 which is wound on last after winder 51 (at winding point 62) is longer as shown, than the holder 97 which winds on the tape 42. The fourth and fifth subconductors 44 and 45 pass through the holders 99 and 100 (which may or may not each comprise a slot shape aperture). In the next winder 52 the subconductors 44 and 45 pass through the rotating holders 97 and 98 of that winder and the subconductors 41-43 wound together pass through the centre holder 96.

The holders 96-100 are mounted in the winder 90 for counter rotation relative to the rotation of the winder, as indicated by arrows C in FIG. 10. In the preferred form an annular gear 102 around an interior part of the rotating wheel 90 is engaged by a gear 103 around the periphery of each holder 96-110 to cause the holders 96-100 to counter rotate in the direction of arrows C as the rotating wheel 90 moves in the direction of arrow B, at a speed such that the slot shaped apertures 97*a*-100*a* in the holders 97-100 remain in a horizontal orientation. The centre holder 96 also rotationally mounted within the wheel 90 is in turn geared to one or more of the holders 97-100 so that the centre holder 96 similarly counter rotates to maintain the slot shaped aperture through the centre holder horizontal. Thus as subconductors move forward through the winder they are rotated or orbited about the centre subconductor or group without themselves rotating or twisting about their longitudinal axes, while the centre subconductor or group also is also held in a constant orientation about its longitudinal axis.

FIG. 12 is a schematic cross-section of drive unit 120. The drive unit consists of a pair of opposing travelling belts 212 and 222 which grip and draw all of the subconductors through the machine. Alternatively the drive unit may comprise a pair or a series of pairs of nip rollers which grip and pull the subconductors or wound conductor and thus subconductors through the machine. The drive unit operates to pull the subconductors through the machine at a forward rate synchronised to the rotational rate of the winders and rotating spool holder.

Figure 13:
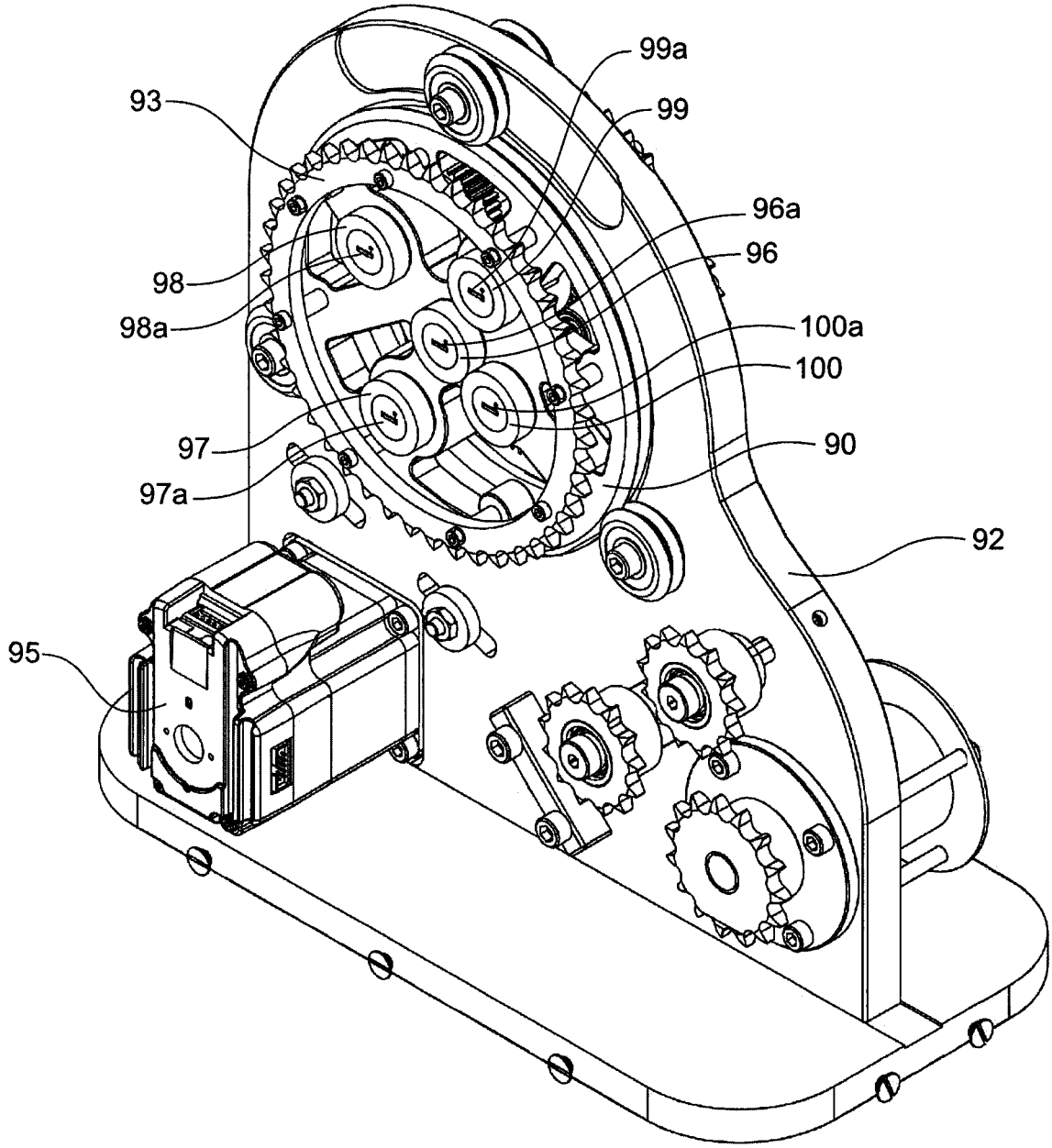
FIG. 13 is a view similar to FIG. 9 of the same part but of another embodiment of a cable winding machine.

FIG. 13 is a view similar to that of FIG. 9 but of a winder of an alternative embodiment and in particular of the embodiment shown in FIG. 4 in which the subconductor holders for the active strands wound on after that winder instead of being of different lengths in the machine direction (as in the winder embodiment of FIGS. 6-12) are spaced at different radii from the central axis of the winder. Similar reference numerals in FIG. 13 indicate similar elements as in the winder of FIGS. 9-11. The winder of FIG. 13 is chain driven from motor 95 rather than gear driven. In this embodiment holder 98 for the first active strand wound on following the winder is spaced at a greater radius from holder 96 through which passes the centre strand or strand group, than the holder 97. On the other exit side of the winder of FIG. 13 (not shown) the holders 97 and 98 have a similar length.

Figure 14:
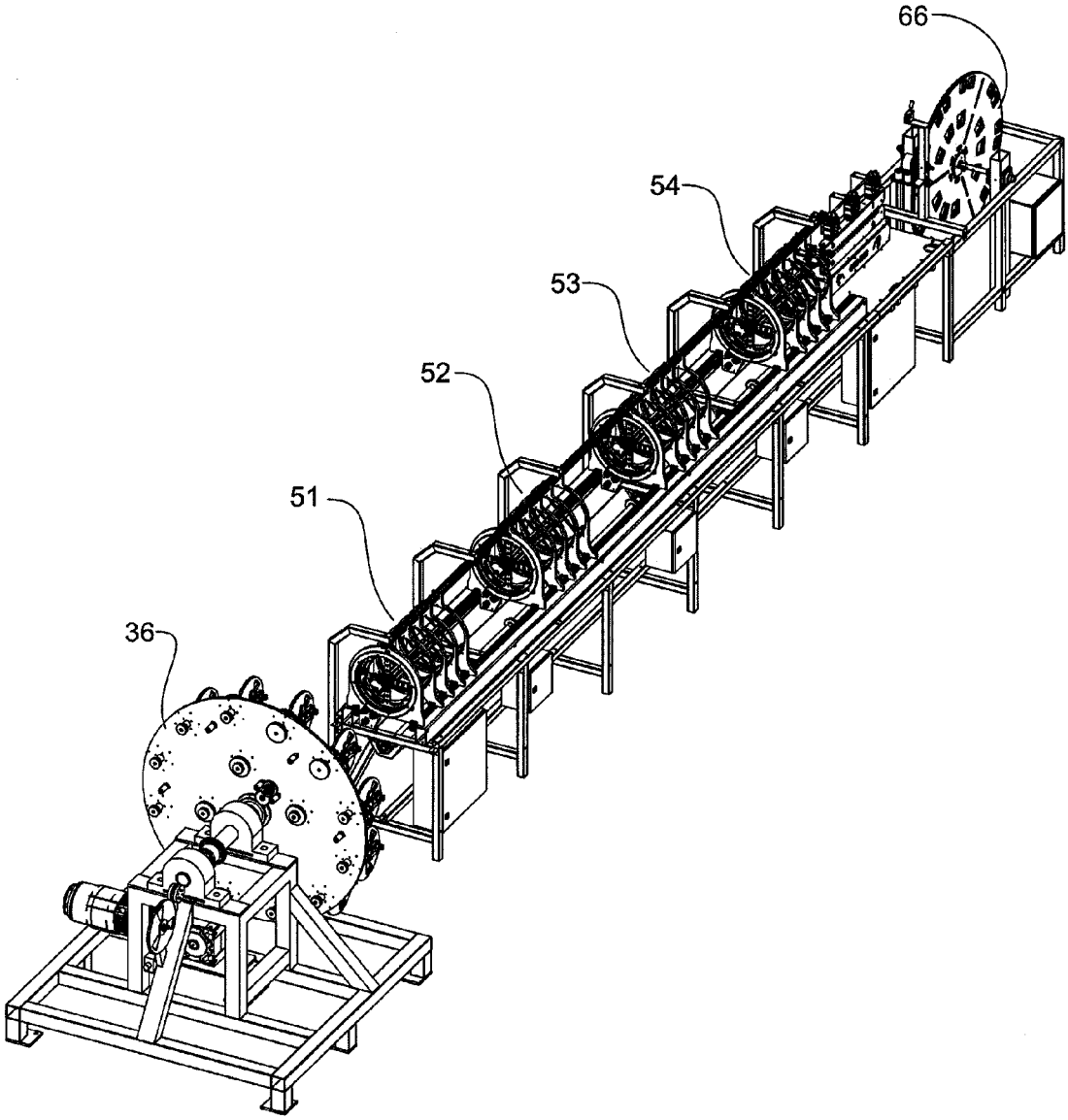
FIG. 14 is a perspective view of another embodiment of a cable winding machine of the invention.
Figure 15:
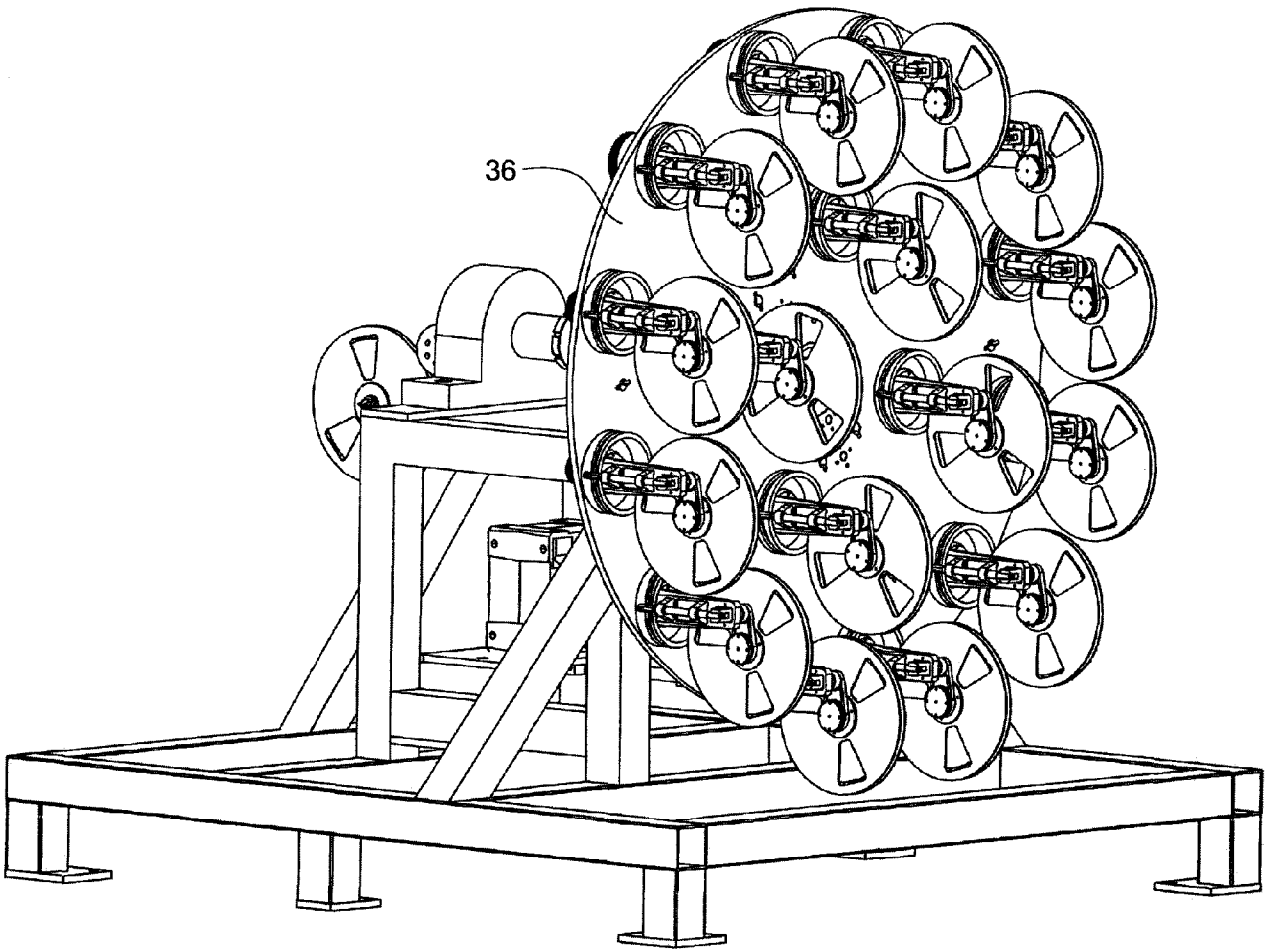
FIG. 15 is a perspective view of the feeder spools and rotating feeder spool holder of the machine of FIG. 14.

The machine embodiment shown in FIGS. 6-12 and described above is for winding cable from five subconductors and does so by winding two subconductors onto the centre subconductor (winder 51) or centre group (winder 52) in two successive winder stages. Additional subsequent winders may be provided for winding on additional subconductors and/or each winding stage may wind on three or more subconductors. FIG. 14 schematically illustrates a machine comprising four winding stages 51-54 each of which winds on four subconductors to the centre conductor or centre subconductor group. FIG. 15 shows rotating spool holder 36 for the machine of FIG. 14, which is generally similar in construction to that of FIGS. 7 and 8 except that the rotating spool holder mounts 16 individual subconductor unwind spools.

In a yet alternative embodiment a machine may comprise only a single winder. For example if the winder 52 of the machine of FIGS. 6-12 is omitted, the machine will produce composite cable comprising three subconductor strands wound together. The number of subconductors wound on by such a single winder may be increased, so that a machine comprising a single winding stage winds via that winding stage nine subconductors for example. The holders of the machine are arranged so that following the winder there are nine winding points at each of which one subconductor winds on.

The preferred embodiment machines described above are arranged to hold the subconductors in a predetermined orientation about their longitudinal axes as the subconductors move through the machine and in particular subconductor tapes in a horizontal orientation. In an alternative embodiment it may not be essential that the machine and winders are arranged to maintain the orientation of each of the conductors about their longitudinal axis. The holders in each winder may be arranged to hold the subconductors sufficiently to rotate them about the centre conductor or group while allowing the subconductors that are rotated to in turn twist about their longitudinal axis.

Preferred forms of the machine are designed for winding Robel cable from subconductors having a serpentine shape, and in which each subconductor is an HTS subconductor comprising a layer of an HTS compound thereon, but in alternative embodiments the machine may be arranged to wind cable from serpentine non-HTS conductors such as serpentine copper conductors for example, or cable from conductors which have a non-serpentine shape.

In the preferred form of machine described with reference to FIGS. 6-12 the spool holder 36 is belt driven and the winders are gear driven, in each case from an electric motor but other drive systems may be utilised and for example the spool holder 36 may be gear driven and all of the spool holder and the winders may be driven by a direct drive stepper motor for example.

It is obvious that at set up of the machine rotation of all of the spool holder and winders and the drive unit 120 must be carefully synchronised and the relative rotational position of each of the unwind spools for the subconductors must be relatively positioned where the cable is being wound from serpentine conductor as described, to ensure that the cable is successfully wound as described above.

The foregoing describes the invention including a preferred form thereof. Alterations and modifications as will be obvious to those skilled in the art are intended to be incorporated within the scope hereof as defined in the accompanying claims.

The invention claimed is:

1. A cable winding machine for winding a plurality of subconductors into a cable comprising:

a subconductor feeder or feeders arranged to move through the machine in a machine direction multiple subconductors having a width dimension across a longitudinal axis greater than a depth dimension through the longitudinal axis perpendicular to the width dimension, as the subconductors are wound together into a cable by the machine, a holder arranged to hold a first subconductor as it moves forward through the machine, a first winder arranged to rotate at least a second subconductor and a third subconductor about the first subconductor as the first, second and third subconductors move through the machine in the machine direction, so that the second subconductor winds with the first subconductor and then the third subconductor winds with the first and second subconductors, after the winder in the machine direction, said first winder being arranged to hold said second and third subconductors in a predetermined orientation relative to said first subconductor and with each other as the first winder rotates the second, third, and any further subconductors about the first subconductor, so that the width dimensions of the subconductors remain substantially parallel to one another as the subconductors move through the machine and are wound together.

2. A cable winding machine according to claim 1 wherein said first winder is arranged to rotate said second and third subconductors and also at least one other subconductor having a width dimension across a longitudinal axis greater than a depth dimension through the longitudinal axis perpendicular to the width dimension, so said other subconductor or a first said other subconductor winds with the first, second, and third subconductors and thereafter any other subconductors rotated by the first winder wind one after another with the subconductors wound together previously, said first winder being arranged to hold said other subconductor(s) wound by the first winder in a predetermined orientation relative to said first subconductor and the subconductors wound together previously as the first winder rotates said other subconductor(s), so that the width dimensions of the subconductors remain substantially parallel to one another as the subconductors move through the machine and are wound together.

3. A cable winding machine according to claim 1 also comprising a second winder after the first winder in the machine direction and arranged to rotate at least one further subconductor about the subconductors wound together by the first winder, so that a said further subconductor winds following the second winder with the subconductors wound together by the first winder, or where the second winder is arranged to rotate two or more said further subconductors, said further subconductor(s) having a width dimension across a longitudinal axis greater than a depth dimension through the longitudinal axis perpendicular to the width dimension, so that a first further subconductor winds following the second winder with the subconductors wound together by the first winder, and then any other said further subconductors rotated by the second winder wind one after another with the subconductors wound together previously, said second winder also being arranged to hold said further subconductor(s) in said predetermined orientation so that the width dimension of the further subconductor(s) remains substantially parallel to the width dimension of subconductors wound together by the first winder as the further subconductor(s) move(s) forward through the machine and as the second winder rotates said further subconductor(s) about the subconductor(s) wound together by the first winder.

4. A cable winding machine according to claim 3 also comprising one or more further winders after the second winder in the machine direction, each further winder arranged to rotate at least one additional subconductor about the subconductors wound together by the prior winders so that a said additional subconductor winds following the further winder with the subconductors wound together by the prior winders, or where the further winder is arranged to rotate two or more additional subconductors, said further subconductor(s) having a width dimension across a longitudinal axis greater than a depth dimension through the longitudinal axis perpendicular to the width dimension, so that a first additional subconductor winds following the further winder with the subconductors wound together by the prior winders, and then any other said additional subconductors wind rotated by the prior winder wind one after another with the subconductors wound together previously, each of said one or more further winders also being arranged to hold said additional subconductor(s) in said predetermined orientation so that the width dimension of the additional subconductor(s) remains substantially parallel to the width dimension of subconductors wound together by the prior winders as the additional subconductor(s) move(s) forward through the machine and as the one or more further winders rotate(s) said additional subconductor(s) about the subconductor(s) wound together by the prior winders.

5. A cable winding machine according to claim 1 wherein said first winder is arranged to hold said second subconductor for further in the machine direction than said first subconductor and to hold said third subconductor for further in the machine direction than said second subconductor so that said third subconductor winds with the first and second subconductors after in the machine direction the second subconductor winds with the first subconductor.

6. A cable winding machine according to claim 2 wherein said first winder is arranged to hold said second subconductor for further in the machine direction than said first subconductor and to hold said third subconductor for further in the machine direction than said second subconductor so that said third subconductor winds with the first and second subconductors after in the machine direction the second subconductor winds with the first subconductor, and wherein said first winder is arranged to hold a said other subconductor for further in the machine direction than said third subconductor and is arranged to hold any further said other subconductors for further again in the machine direction, so that said other subconductors rotated by the first winder wind one after another with the subconductors wound together previously.

7. A cable winding machine according to claim 3 wherein said first winder is arranged to hold said second subconductor for further in the machine direction than said first subconductor and to hold said third subconductor for further in the machine direction than said second subconductor so that said third subconductor winds with the first and second subconductors after in the machine direction the second subconductor winds with the first subconductor, wherein said first winder is arranged to hold a said other subconductor for further in the machine direction than said third subconductor and is arranged to rotate and hold any further said other subconductors for further again in the machine direction, so that said other subconductors rotated by the first winder wind one after another with the subconductors wound together previously, and wherein said second winder is arranged to hold a number of said further subconductors for different spacings in the machine direction, so that said further subconductors rotated by the second winder wind one after another with the subconductors wound together previously.

8. A cable winding machine according to claim 4 wherein said first winder is arranged to hold said second subconductor for further in the machine direction than said first subconductor and to hold said third subconductor for further in the machine direction than said second subconductor so that said third subconductor winds with the first and second subconductors after in the machine direction the second subconductor winds with the first subconductor, wherein said first winder is arranged to hold a said other subconductor for further in the machine direction than said third subconductor and is arranged to hold any further said other subconductors for further again in the machine direction, so that said other subconductors rotated by the first winder wind one after another with the subconductors wound together previously, wherein said second winder is arranged to hold a number of said further subconductors for different spacings in the machine direction, so that said further subconductors rotated by the second winder wind one after another with the subconductors wound together previously, and wherein each said further winder is arranged to rotate and hold a number of said additional subconductors for different spacings in the machine direction, so that said additional subconductors rotated by the further winder wind one after another with the subconductors wound together previously.

9. A cable winding machine according to claim 1 wherein each winder is arranged to hold the subconductors which it winds, by a holder arranged to counter rotate within the winder and about the machine direction, as the winder rotates about the machine direction, to maintain the subconductors in said predetermined orientation.

10. A cable winding machine according to claim 9 wherein each said holder comprises an aperture through which a subconductor can move in the machine direction and which aperture has a dimension across the machine direction greater than another dimension through the machine direction perpendicular to the width direction.

11. A cable winding machine according to claim 9 wherein each said holder mounted in the winder for said counter rotation is geared to the winder to drive the holder to counter rotate relative to the winder as the winder rotates in another direction, and at a speed which maintains a subconductor passing through said holder in said predetermined orientation.

12. A cable winding method for winding a plurality of subconductors into a cable, comprising:

moving multiple subconductors having a width dimension across a longitudinal axis greater than a depth dimension through the longitudinal axis perpendicular to the width dimension, through a cable winding machine in a machine direction as the subconductors are wound together into a cable by the machine, holding a first subconductor as it moves forward through the machine, and at a first winding stage of the cable winding machine, rotating at least a second subconductor and a third subconductor about the first subconductor as the first, second and third subconductors move through the machine, so that the second subconductor winds with the first subconductor and then the third subconductor winds with the first and second subconductors, after the winder in the machine direction, while holding said second and third subconductors in a predetermined orientation relative to said first subconductor and with each other while rotating the second and third subconductors about the first subconductor, so that the width dimensions of the subconductors remain substantially parallel to one another.

13. A method according to claim 12 comprising at a second subsequent winding stage of the cable winding machine rotating one or more other subconductors having a width dimension across a longitudinal axis greater than a depth dimension through the longitudinal axis perpendicular to the width dimension, so a first said other subconductor winds with the first, second, and third subconductors and thereafter any other further subconductors wind one after another with the subconductors wound together previously, while holding said one or more other subconductors in a predetermined orientation relative to said first subconductor and with each other while rotating said one or more other subconductors, so that the width dimensions of the subconductors remain substantially parallel to one another.

14. A method according to claim 12 wherein the subconductors have a serpentine shape.

15. A method according to claim 14 including rotating said second subconductor about the first subconductor with a predetermined longitudinal displacement of the second subconductor relative to the first subconductor, and rotating said third subconductor about the first and second subconductors with a predetermined longitudinal displacement of the third subconductor relative to the first and second subconductors.

16. A method according to claim 14 including moving the subconductors through the cable winding machine in the machine direction as the subconductors are wound together into a cable by the machine, with a longitudinal displacement between the subconductors of L/n where L is a transposition length of the serpentine subconductors and n is the total number of subconductors.

17. A method according to claim 16 including moving the subconductors through the cable winding machine and operating the cable wonding machine, with a step and rotate action in which after each rotation of all winders by 180° in unison, all subconductors are moved through the machine in the machine direction by L/2 where L is the subconductor transposition length.

18. A method according to claim 16 including winding the subconductors into a cable with a Roebel configuration.

19. A method according to claim 14 including rotating said second subconductor about the first subconductor with a predetermined longitudinal displacement of the second subconductor relative to the first subconductor, and rotating said third subconductor about the first and second subconductors with a predetermined longitudinal displacement of the third subconductor relative to the first and second subconductors.

20. A method according to claim 14 including moving the subconductors through the cable winding machine in the machine direction as the subconductors are wound together into a cable by the machine, with a longitudinal displacement between the subconductors of L/n where L is a transposition length of the serpentine subconductors and n is the total number of subconductors.

21. A method according to claim 20 including moving the subconductors through the cable winding machine and operating the cable winding machine, with a step and rotate action in which after each rotation of all winders by 180° in unison, all subconductors are moved through the machine in the machine direction by L/2 where L is the subconductor transposition length.

22. A method according to claim 21 including winding the subconductors into a cable with a Roebel configuration.

23. A method according to claim 22 wherein the subconductors are high $T_c$ superconducting subconductors.

24. A method according to claim 23 wherein the subconductors comprise a high $T_c$ superconducting layer.

25. A cable winding method for winding a plurality of subconductors into a cable, comprising:

moving multiple subconductors through a cable winding machine in a machine direction as the subconductors are wound together into a cable by the machine;

holding a first serpentine subconductor as it moves forward through the machine; and at a first winding stage of the cable winding machine, rotating at least a second serpentine subconductor and a third serpentine subconductor about the first subconductor as the first, second and third subconductors move through the machine, so that the second subconductor winds with the first subconductor and then the third subconductor winds with the first and second subconductors, after the winder in the machine direction, including rotating said second subconductor about the first subconductor with a predetermined longitudinal displacement of the second subconductor relative to the first subconductor, and rotating said third subconductor about the first and second subconductors with a predetermined longitudinal displacement of the third subconductor relative to the first and second subconductors.

26. A method according to claim 25 comprising at a second subsequent winding stage of the cable winding machine rotating one or more other serpentine subconductors so a first said other subconductor winds with the first, second, and third subconductors and thereafter any other further subconductors wind one after another with the subconductors wound together previously, including rotating each of said one or more other serpentine subconductors with a predetermined longitudinal displacement.

27. A method according to claim 25 including holding the first subconductor in a predetermined orientation as it moves through the machine and said second, third, and any one or more other subconductors in a predetermined orientation relative to said first subconductor and with each while rotating the second, third, and one or more other subconductors about the first subconductor.

28. A method according to claim 27 wherein the serpentine subconductors each have a width dimension across a longitudinal axis greater than a depth dimension through the longitudinal axis perpendicular to the width direction and wherein holding the subconductors in said predetermined orientation comprises holding the subconductors with the width dimension of the subconductors parallel as the subconductors move through the machine.

29. A method according to claim 25 including moving the subconductors through the cable winding machine in the machine direction as the subconductors are wound together into a cable by the machine, with a longitudinal displacement between the subconductors of L/n where L is a transposition length of the serpentine subconductors and n is the total number of subconductors.

30. A method according to claim 29 including moving the subconductors through the cable winding machine and operating the cable winding machine, with a step and rotate action in which after each rotation of all winders by 180° in unison, all subconductors are moved through the machine in the machine direction by L/2 where L is the subconductor transposition length.

31. A method according to claim 29 including winding the subconductors into a cable with a Roebel configuration.

32. A method according to claim 31 wherein the subconductors are high $T_c$ superconducting subconductors.

33. A method according to claim 32 wherein the subconductors comprise a high $T_c$ superconducting layer.

* * * * *